US005297941A

United States Patent [19]

Park

[11] Patent Number: 5,297,941

[45] Date of Patent: Mar. 29, 1994

[54] CONTROL SYSTEMS FOR HYDRAULIC PUMPS OF THE VARIABLE DISPLACEMENT TYPE

[75] Inventor: An H. Park, Changwon, Rep. of Korea

[73] Assignee: Samsung Heavy Industries Co., Ltd., Changwan, Rep. of Korea

[21] Appl. No.: 980,269

[22] Filed: Nov. 23, 1992

[30] Foreign Application Priority Data

Nov. 30, 1991 [KR] Rep. of Korea ..... 91-21878

[51] Int. Cl.[5] ..... F04B 49/00

[52] U.S. Cl. ..... 417/218; 417/222.1

[58] Field of Search ..... 417/218, 222.1, 222.2, 417/274, 279

[56] References Cited

U.S. PATENT DOCUMENTS

| | | | |
|---|---|---|---|
| 4,035,105 | 7/1977 | Dantlgraber | 417/274 |
| 4,077,744 | 3/1978 | Pensa | 417/218 |
| 4,600,364 | 7/1986 | Nakatani et al. | 417/218 |

FOREIGN PATENT DOCUMENTS

| | | | |
|---|---|---|---|
| 0261988 | 12/1985 | Japan | 417/218 |

*Primary Examiner*—Richard A. Bertsch

*Assistant Examiner*—Alfred Basichas

*Attorney, Agent, or Firm*—Abelman Frayne & Schwab

[57] ABSTRACT

A control system for a hydraulic pump of the variable displacement type using a pair of coaxially arranged pressure responding pistons. The control system comprises a servo valve for controlling a conduit of pump delivery pressure which is to be applied to a larger chamber of a servo cylinder in response to the pump delivery pressure and external pilot pressure. The servo valve includes a servo spool for controlling the conduit in order to control the pump delivery pressure, a servo sleeve for movably receiving the servo spool, a pump delivery pressure responding piston for biasing the servo spool in response to the pump delivery pressure, an external pilot pressure responding piston adapted for biasing the servo spool in response to the external pilot pressure and being coaxially arranged with the pump delivery pressure responding piston. The lever assembly causes the servo sleeve to move in accordance with the movement of the servo piston. The lever assembly has an inclined surface part for causing displacement of the servo piston as a function of displacement of the pressure responding pistons to show a characteristic hyperbola.

1 Claim, 5 Drawing Sheets

FIG.8b (PROIR ART)

CONTROL SYSTEMS FOR HYDRAULIC PUMPS OF THE VARIABLE DISPLACEMENT TYPE

BACKGROUND OF THE INVENTION

1. Field of the Invention

The present invention relates in general to a control system for a hydraulic pump of the variable displacement type, and more particularly to a control system for a variable displacement hydraulic pump which is provided with a servo piston and a servo valve, including pressure responding pistons, which is connected to the servo piston by a feedback angle lever and the small diameter end of the servo piston is always applied with pump delivery pressure while the large diameter end of the servo piston is selectively applied with the pump delivery pressure in accordance with control of the servo valve.

2. Description of the Prior Art

Known control system for a hydraulic pump of the variable displacement type, such as disclosed in Japanese Patent Laid-open Publication No. Heisei. 1-116294, generally includes a servo valve and two control spool mechanisms, that is, a horsepower control spool mechanism and a pump delivery control spool mechanism for controlling output power and pump delivery of the hydraulic pump, respectively. The horsepower control mechanism is adapted to control a conduit, through which the pump delivery pressure or a servo pressure is supplied to the large diameter end of the servo piston of a servo cylinder, in accordance with variation of pump delivery pressure of the variable displacement pump applied thereto, while the pump delivery control mechanism is adapted to control a conduit, through which the pump delivery pressure is supplied to the large diameter end of the servo piston, in accordance with external pilot pressure along with the pump delivery pressure. In addition, this known control system includes three lever type of feedback lever mechanism comprising a feedback lever, adapted for connecting an end of a servo spool of the servo valve to the servo piston, and a pair of links adapted for selecting a displacement of the pilot spool mechanisms capable of causing the pump delivery to be reduced and causing the feedback lever to be operated in response to the selected displacement. Thanking for such a construction, the known control system controls the servo piston of the servo cylinder in accordance with variation of the pump delivery pressure or the external pilot pressure and, in this respect, controls the angle of inclination of swash plate of the hydraulic pump of the variable displacement type in order to control the pump delivery.

However, this known control system, including the horsepower control spool mechanism and the pump delivery control spool mechanism, requires the servo valve, a pair of spools responding to the pressures, the three lever type of feedback lever comprising the feedback lever and the pair of links, in result, the construction of the system is inevitably complicated. Also, in this known control system, the horsepower control spool mechanism and the pump delivery control spool mechanism are separately operated so that the known control system has a problem in that the pump delivery control range according to the external pilot pressure, when the pump delivery pressure and the external pilot pressure are applied to the mechanisms at the same time, is narrow under the condition of high pump delivery pressure as shown in the graph of FIG. 8*b* and this deteriorates the control performance in controlling the pump delivery. Furthermore, the known control system is provided with at least two compression coil springs for biasing the spools of the spool mechanisms to a direction opposite to a biasing direction of the actuating force generated by the pump delivery pressure and the external pilot pressure applied to the spools, respectively. In this regard, the relation between the pump delivery Q and the pump delivery pressure Pd has the characteristic curve comprising the three straight lines having different gradients and continued at two inflection points as shown In FIG. 7*b*. Thus, the known control system has another problem in that the output power of an engine for driving the hydraulic pump is not optimally utilized at about the two inflection points of the characteristic curve.

SUMMARY OF THE INVENTION

It is, therefore, an object of the present invention to provide a control system for a hydraulic pump of the variable displacement type in which the above problems can be overcome and which is provided with an angle lever for connecting an end of the servo spool of the servo valve and the servo piston of the servo cylinder, as a result, simplifies a construction of the lever mechanism, improves the control performance in controlling the pump delivery under the condition of high pump delivery pressure and provides a characteristic hyperbola of the pump delivery pressure as a function of the pump delivery, thereby causing the output power of the engine for driving the hydraulic pump to be optimally utilized.

In an embodiment of the present invention, the above object can be accomplished by providing in a control system for a hydraulic pump of the variable displacement comprising a movable servo piston for varying inclination angle of pump swash plate in order to control pump delivery, said servo piston being movably received in a servo cylinder and providing, in cooperation with said servo cylinder, variable smaller and larger cylinder chambers, said smaller cylinder chamber being always applied with pump delivery pressure but said larger cylinder chamber being selectively applied with the pump delivery pressure through a conduit, the improvement comprising: a servo valve for controlling said conduit in response to the pump delivery pressure and external pilot pressure in order to control movement of said servo piston, said servo valve being movable between three positions, a drain position wherein the pump delivery pressure in said larger cylinder chamber to be drained to an oil reservoir through said conduit, a neutral position wherein said conduit is blocked and a feeding position wherein said larger cylinder chamber is applied with the pump delivery pressure through said conduit, and comprising: a servo spool for controlling said conduit in order to control the pump delivery pressure which is to be applied to said larger cylinder chamber, said servo spool being movable in response to said pump delivery pressure and said external pilot pressure in order to be displaced between said three positions; a servo sleeve for movably receiving said servo spool, said servo sleeve being displaceable in response to the movement of the servo piston in order to control, in cooperation with said servo spool, said conduit; a pump delivery pressure responding piston for biasing said servo spool in response to the pump delivery pressure applied thereto; an external pilot pressure responding piston for biasing said servo spool in response to the external pilot pressure applied thereto, said external pilot pressure responding piston being coaxially arranged with said pump delivery pressure responding piston; a pair of first biasing members for biasing said servo spool against biasing force acting on said servo spool owing to the pump delivery pressure and the external pilot pressure; and a second biasing member for biasing said servo sleeve; and a lever assembly for causing said servo sleeve to move in accordance with the movement of said servo piston, said lever assembly comprising: a hinged lever for causing said servo sleeve to move, said lever being pivoted at one end thereof to said servo spool and being turnable about its hinged point; and a push pin for causing said lever to be turned in accordance with the movement of said servo piston, said pin being connected to said servo piston.

Here, the hinged lever of the lever mechanism has an inclined surface part for movably contacting with the push pin. This inclined surface part causes displacement of the servo piston as a function of displacement of the pressure responding pistons to show a characteristic hyperbola.

BRIEF DESCRIPTION OF THE DRAWINGS

The above and other objects, features and other advantages of the present invention will be more clearly understood from the following detailed description taken in conjunction with the accompanying drawings, in which:

FIGS. 7*a* and 7*b* are graphs showing pump delivery as a function of pump delivery pressure, respectively, in which:

FIG. 7*a* shows the present invention; and

FIG. 7*b* shows the prior art; and

FIGS. 8*a* and 8*b* are graphs showing pump delivery as a function of the delivery pressure in consideration of several external pilot pressures, respectively, in which:

FIG. 8*a* shows the present invention; and

FIG. 8*b* shows the prior art.

DETAILED DESCRIPTION OF THE PREFERRED EMBODIMENTS

Figure 1:
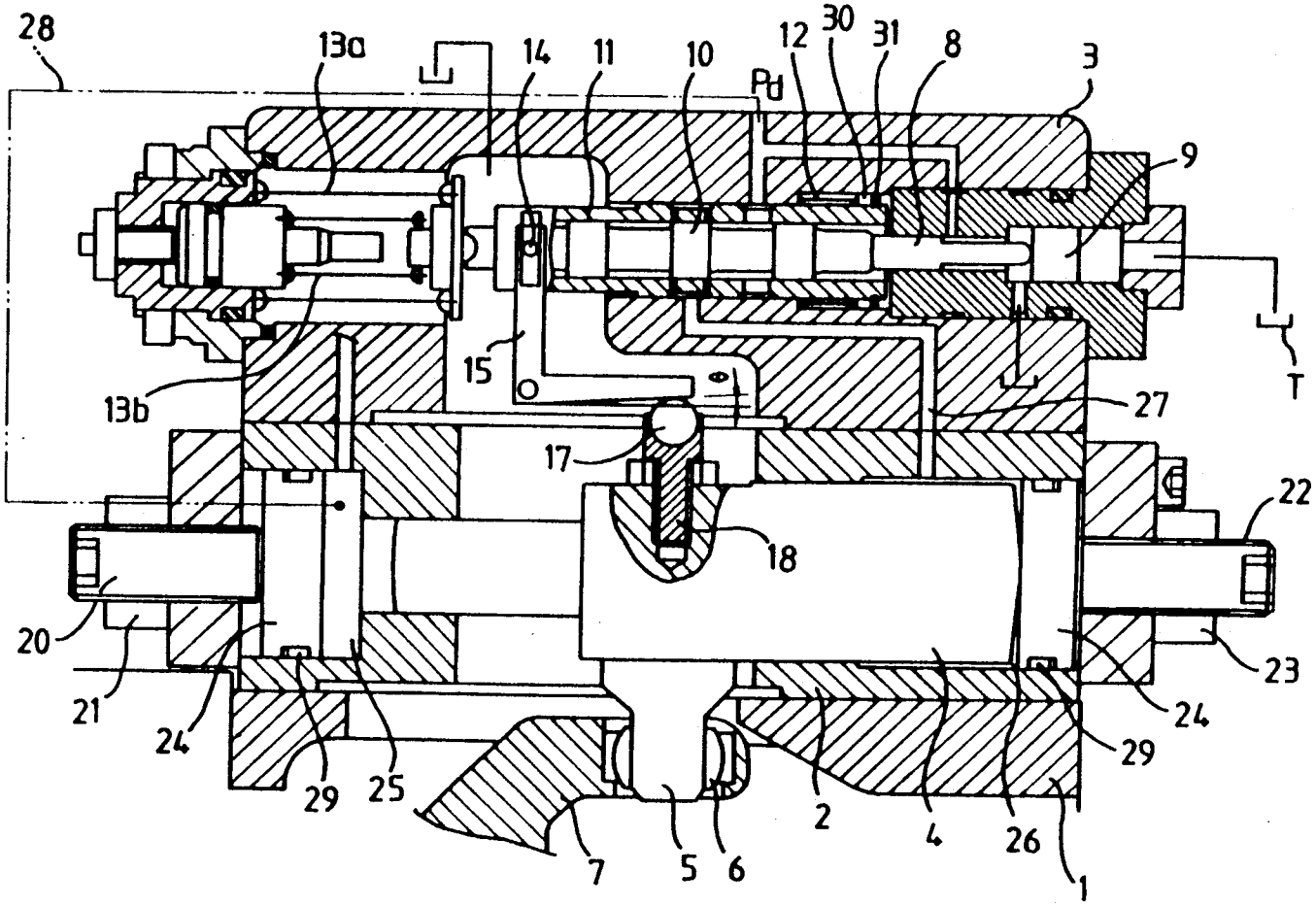
FIG. 1 is a sectioned view of a control system for a hydraulic pump of the variable displacement type in accordance with the present invention.

With reference to FIG. 1 showing an embodiment of a control system of the present invention shown in connection with a hydraulic pump of the variable displacement type, a pump rotor (not shown) and a pump swash plate (7) are assembled to each other in a pump main housing 1. Above the pump main housing 1, a servo cylinder block 2 wherein a servo piston 4 is slidably inserted. This servo piston 4 is hinged at its middle portion to an end of the pump swash plate 7 by a ball joint comprising a ball pin 5 and a bearing 6. In addition, a servo valve block 3 is disposed above the servo cylinder block 2 and encloses a servo valve. This servo valve comprises a biasing piston assembly comprising a horsepower control biasing piston 8 and a pump delivery control biasing piston 9 which are coaxially arranged in order to cooperate with each other. The servo valve further comprises, at a side thereof opposite to the pistons 8 and 9, a pair of springs 13*a* and 13*b*, preferably compression coil springs, which are displaced in response to the biasing force generated by the pressure applied to the end surfaces of the pistons 8 and 9. Also, in order to constitute the servo valve in cooperation with the aforementioned pistons 8 and 9 and the springs 13*a* and 13*b*, a servo spool 10 is laterally disposed between an end of the piston 8 and the springs 13*a* and 13*b* inside the servo valve block 3. This servo spool 10 is adapted to transmit the biasing force of the pistons 8 and 9 caused by the pump delivery pressure and the external pilot pressure to the springs 13*a* and 13*b* and controls, in accordance with the displacement thereof, a first conduit 27 communicating with the larger cylinder chamber 26 of the servo cylinder. This servo spool 10 is slidably inserted in a sleeve 11.

Figure 2:
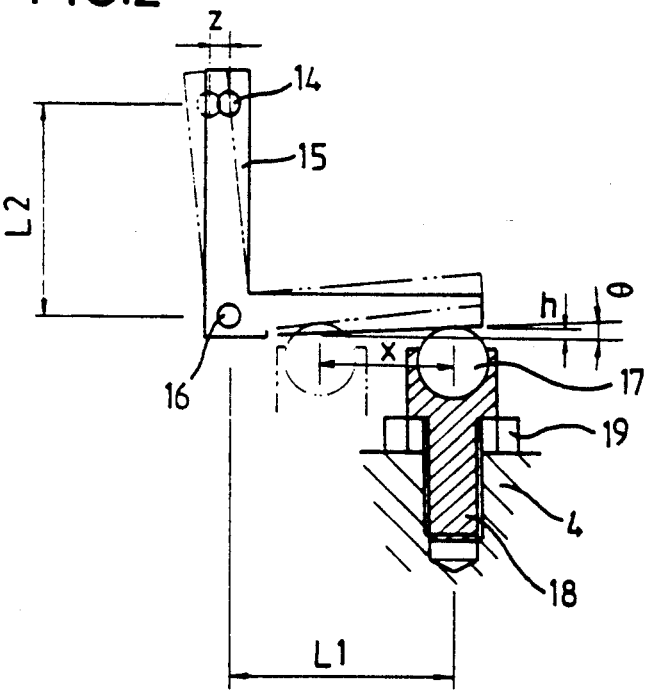
FIG. 2 is a schematic view showing the operation of an angle lever of the control system of FIG. 1.
Figure 3:
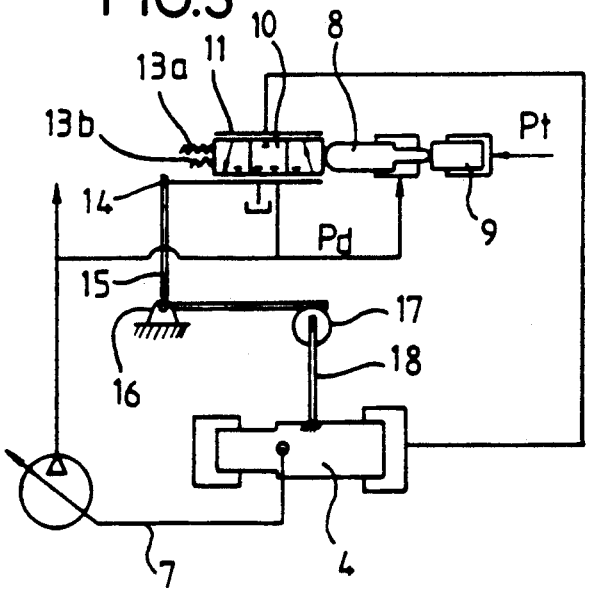
FIG. 3 is a schematic view showing the operational theory of the control system of the present invention.
Figure 4:
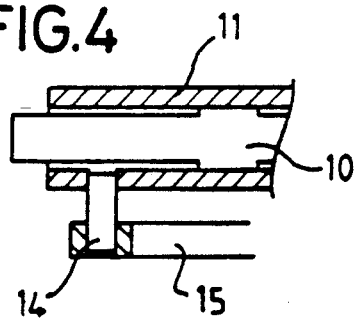
FIG. 4 is a plane sectioned view showing the connection of a servo sleeve to the angle lever in accordance with the present invention.

The sleeve 11 of the servo valve is connected to the servo piston 4 by an angle lever 15 in such a manner that the sleeve 11 laterally moves depending on the displacement of the servo piston 4. Referring now to FIG. 2 showing the operation of the angle lever 15, the lever 15 is hinged at its inflection part to the valve block 3 by a hinge pin 16. The lateral arm of the lever 15 always comes into contact with a ball 17 rotatably jointed to a push pin 18 which is in turn connected to the servo piston 4 at a position spaced apart from the hinge pin 16 by a distance of L1 and has an inclined under surface having inclination angle $\Theta$ with respect to the horizontal surface of the servo piston 4. On the other hand, the erect arm of the lever 15 is slidably connected to a slot of the sleeve 11 by a pin 14 as depicted in FIG. 4 at a position spaced apart from the hinge pin 16 by a distance L2. Here, the push pin 18 receives the ball 17 in such a manner that the ball 17 is freely rotated in a cup-shaped receiver formed at the upper end of the push pin 18. Also, the push pin 18 has an outer-threaded stem which is adapted to be screwed into an inner-threaded connection hole of the servo piston 4, thereby accomplishing its connection to the servo piston 4. In connection of the push pin 18 to the servo piston 4, the push pin 18 is connected to the piston 4 such that it is freely controlled in its height by handling a height adjustment nut 19.

Turning again to FIG. 1, a compression coil spring 12 is resiliently supported around the sleeve 11 between a step of the servo valve block 3 and a stopper 30 supported by an annular step ring 31. Here, the lateral arm of the angle lever 15 always comes into contact with the ball 17 and the erect arm of the lever 15 is connected to the sleeve 11 as described above, therefore, the lever 15 turns counterclockwise about the hinge pin 16 when the servo piston 4 moves leftwards and this makes the sleeve 11 move leftwards with compression of the spring 12. On the other hand, when the servo piston 4 moves rightwards, the spring 12 biases the sleeve 11 rightwards and the angle lever 15 turns clockwise about the pin 16.

The larger cylinder chamber 26 of the servo cylinder communicates with the inner space of the servo valve through the conduit 27 and, in this respect, is selectively applied with the pump delivery pressure Pd when both the servo spool 10 and sleeve 11 are positioned so as to open the conduit 27. Otherwise, the pump delivery pressure Pd inside the larger cylinder chamber 26 may be drained to an oil reservoir T as will be described bellow. On the contrary, the smaller cylinder chamber 25 of the servo cylinder is always applied with the pump delivery pressure Pd.

In the servo cylinder, the maximum displacement (for accomplishing the maximum pump delivery) of the larger cylinder chamber 26 is controlled by a maximum pump delivery adjustment screw 22 and a lock nut 23, while the minimum displacement (for accomplishing the minimum pump delivery) of the smaller cylinder chamber 25 is controlled by a minimum pump delivery adjustment screw 20 and a lock nut 21. In order to accomplish sealing of the chambers 25 and 26, the chambers 25 and 26 tightly receives a sealing stopper 24 carrying thereabout an annular sealing ring 29, respectively, thereby preventing fluid under pressure from being leaked from the chambers 25 and 26. These sealing stoppers 24 come into contact with inner ends of the adjustment screws 20 and 22, respectively.

Hereinafter, the operational effect of the present control system having the aforementioned construction will be described.

Upon driving the engine for generating output power for driving the hydraulic pump, the pump delivery pressure Pd is directly applied to the horsepower control biasing piston 8 for controlling the horsepower and in turn biases the servo spool 10 leftwards in order to cause the compression coil spring 13*a* to be compressed. At initial state or low pressure state of the servo valve, the restoring force of the compression coil spring 13*a* is higher than the biasing force of the fluid under pressure applied to the servo spool 10, in result, the servo spool 10 is forced to move rightwards, otherwise stated, toward the biasing piston 8. In this respect, the conduit 27 for supplying the pump delivery pressure Pd to the larger cylinder chamber 26 of the servo cylinder communicates with the oil reservoir T in order to permit the fluid under pressure in the larger cylinder chamber 26 to be drained to the reservoir T. Here, this position is named as a drain position.

Figure 7A:
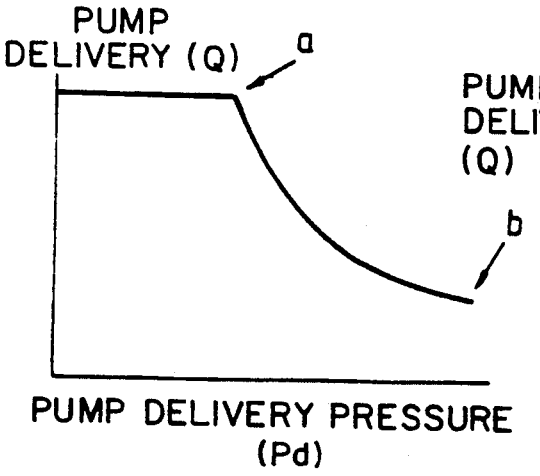
Figure 7B:
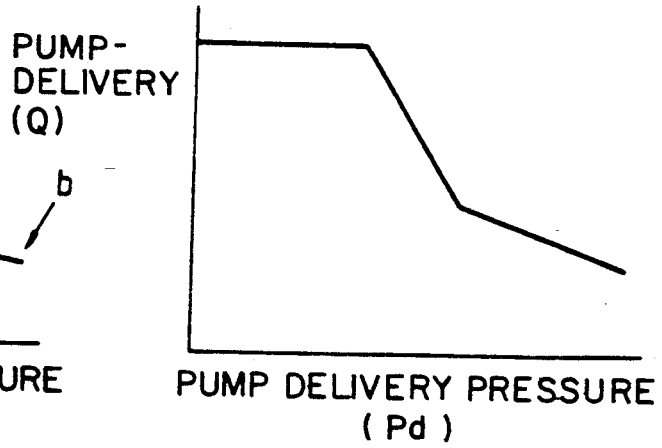
FIG.7b (PRIOR ART)

Meanwhile, as the pump delivery pressure Pd applied to the servo valve is increased, the biasing force of the servo spool 10 caused by the pump delivery pressure Pd is increased. In this state, when the pump delivery pressure Pd reaches a pressure level corresponding to the inflection point "a" of the characteristic hyperbola of FIG. 7*a*, the servo spool 10 moves leftwards in order to shift its position from the drain position to a neutral position wherein the conduit 27 is blocked. At this neutral position, additional pump delivery pressure Pd is not applied to the larger cylinder chamber 26 and the pump delivery pressure Pd in larger chamber 26 is not drained to the oil reservoir T.

When the pump delivery pressure Pd applied to the servo valve is increased, the servo spool 10 moves leftwards and shifts its position from the neutral position to a feeding position wherein the conduit 27 is opened and the pump delivery pressure Pd is applied to the larger cylinder chamber 26 of the servo cylinder through the conduit 27. At this time, the pump delivery pressure Pd is also applied to the smaller cylinder chamber 25 since this smaller cylinder chamber 25 is constructed to be always applied with the pump delivery pressure Pd as described above. In result, there occurs pressure difference between the smaller and larger chambers 25 and 26, applied with the same pressure Pd, due to difference of sectioned area between the smaller diameter part and the larger diameter part of the servo piston 4. In this respect, the servo piston 4 moves leftwards and this causes the pump delivery Q to be reduced.

On the other hand, the leftward movement of the servo piston 4 causes the push pin 18 connected thereto to move leftwards along with the ball 17 rotatable received by the cup-shaped receiver of the push pin 18. As a result, the angle lever 15 turns counterclockwise about the hinge pin 16 since its lateral arm is upwardly biased by the leftward moving ball 17. The counterclockwise turning of the angle lever 15 then causes the sleeve 11, which is connected at its end to the erect arm of the lever 15 by the pin 14, to move leftwards with compression of the coil spring 12. In this state, the servo spool 10 and the sleeve 11 return to their neutral position wherein the larger cylinder chamber 26 is neither applied with additional pump delivery pressure Pd nor communicates with the oil reservoir T. Upon accomplishing this position, the servo piston 4 stops moving.

Here, the relation between the displacement X of the servo piston 4 and the displacement Z, otherwise state, displacement of sleeve feedback, of the servo spool 10 is expressed as follows:

$$X=(L1^2+h^2).Z/(L1.Z+L2h)$$

wherein

X is the displacement of the servo piston 4;

Z is the displacement of the servo spool 10 (or the sleeve 11);

L1 is the length of the lateral arm of the angle lever 15 between the hinge pin 16 and the rotatable ball 17;

L2 is the length of the erect arm of the lever 15 between the hinge pin 16 and the pin 14; and h is the initially preset inclined height of the lever 15, here $h=L1.\tan\Theta$.

Figure 6:
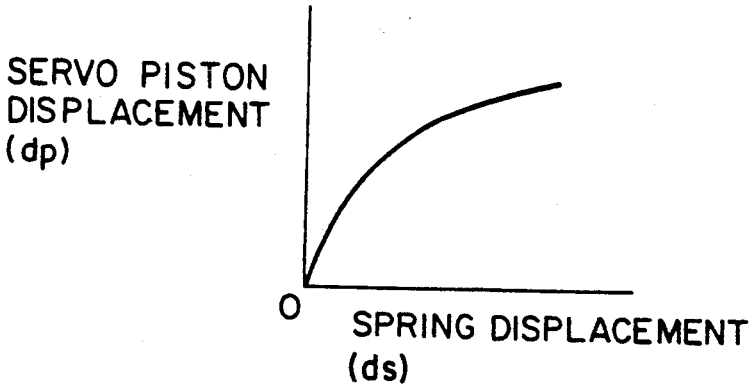
FIG. 6 is a characteristic curve of the servo piston displacement as a function of the spring displacement of the control system in accordance with the present invention.

In accordance with the above expression, the characteristic curve of the displacement X of the servo piston 4 with respect to the displacement Z of the servo spool 10 shows the characteristic hyperbola of FIG. 6. In addition, it is possible to obtain desired optimal Z-X diagram, showing the relation between the pump delivery pressure Pd and the pump delivery Q, by changing the parameters L1, L2 and h of the above expression. In this respect, the present invention makes the Pd-Q diagram to be approximate to the ideal pump input power diagram.

As described above, the pump delivery Q is reduced as the pump delivery pressure Pd applied to the servo spool 10 is increased. Meanwhile, when the pump delivery pressure Pd applied to the servo spool 10 is reduced, the biasing force of the horsepower control biasing piston 8 is reduced and this causes the servo spool 10 to shift its position from the neutral position to the drain position. In result, the servo piston 4 moves rightwards due to pressure difference between the smaller cylinder chamber 25 and the larger cylinder chamber 26 and this makes the fluid under pressure or the pump delivery pressure Pd in the larger cylinder chamber 26 to be drained to the oil reservoir T through the conduit 27, thereby increasing the pump delivery Q.

When the servo piston 4 moves rightwards as aforementioned, the push pin 18 connected to the servo piston 4 moves rightwards together with the rotatable ball 17 carried thereby and this permits the sleeve 11 to move rightwards owing to the restoring force of the compression coil spring 12 and then the angle lever 15 to resiliently turn clockwise about the hinge pin 16. Thus, the sleeve 11 accomplishes its neutral position and blocks the conduit 27, thereby causing the servo piston 4 to stop moving.

Figure 8A:
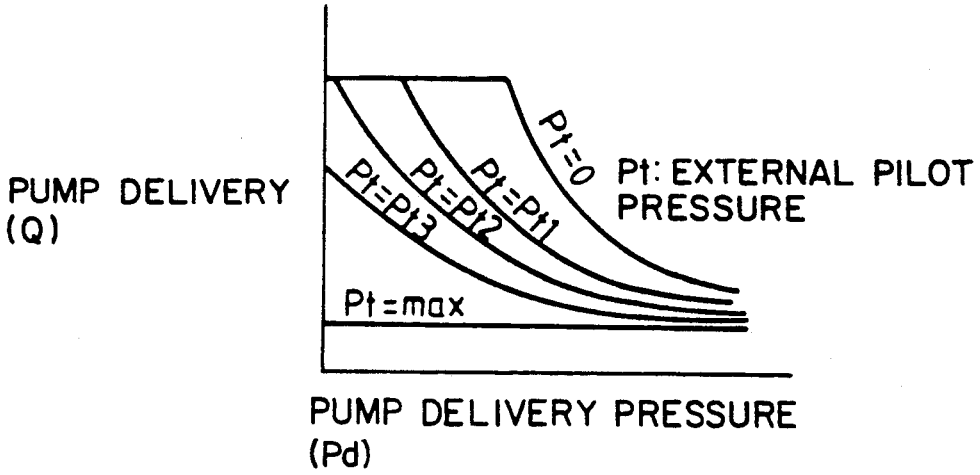
Figure 8A:
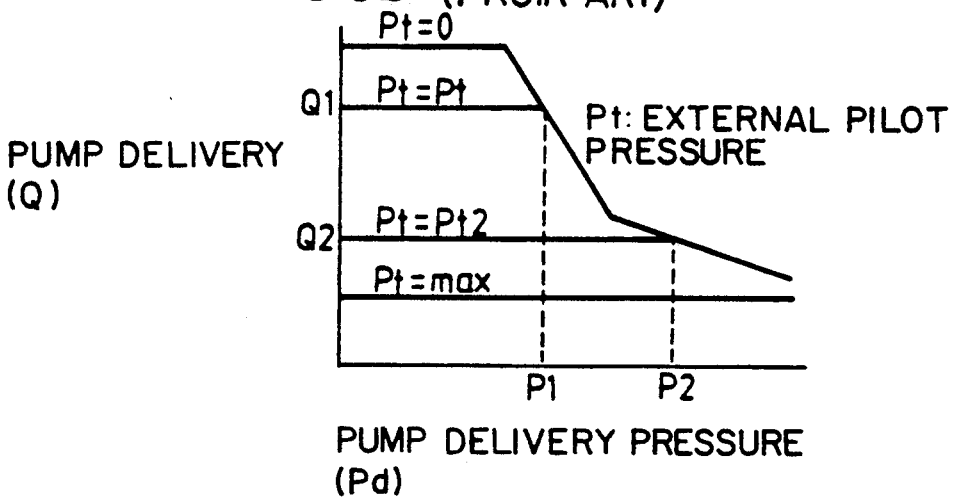

On the other hand in control of the pump delivery Q, the pump delivery control biasing piston 9 coaxially arranged with the horsepower control biasing piston 8 is applied with the external pilot pressure Pt and this pilot pressure Pt along with the pump delivery pressure Pd causes the compression coil spring 13*a* to be compressed and displaced. Otherwise stated, the pump delivery Q is changed in accordance with the external pilot pressure Pt under the same pump delivery pressure Pd. As shown in FIG. 8*a*, the diagram, or Pd-Q diagram, of the pump delivery Q as a function of the delivery pressure Pd in consideration of several external pilot pressures Pts shows that it is approximate to the ideal pump input power diagram. As noted in the Pd-Q diagram of FIG. 8*a*, the pump delivery Q is changed in accordance with the external pilot pressure Pt under the same pump delivery pressure Pd.

Figure 5A:
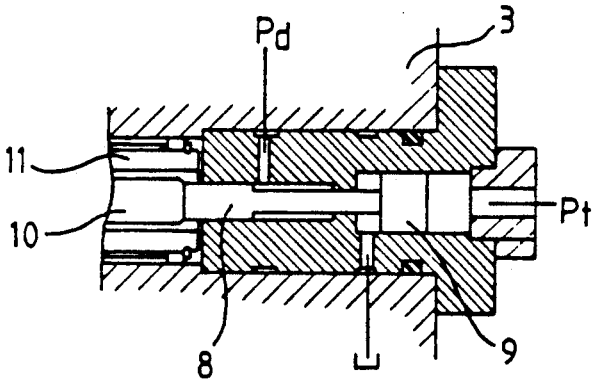
FIGS. 5*a* to 5*c* are sectioned views showing different embodiments of a horsepower control biasing piston and a pump delivery control biasing piston in accordance with the present invention, respectively.
Figure 5B:
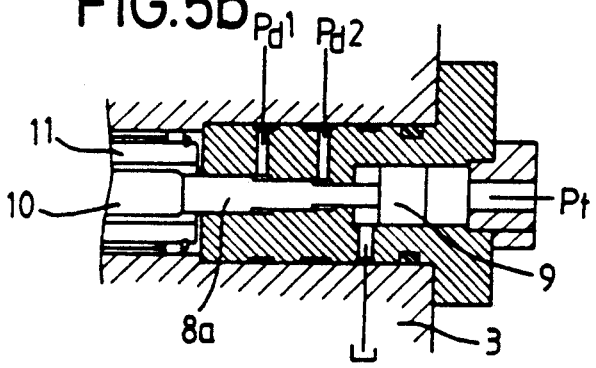
Figure 5C:
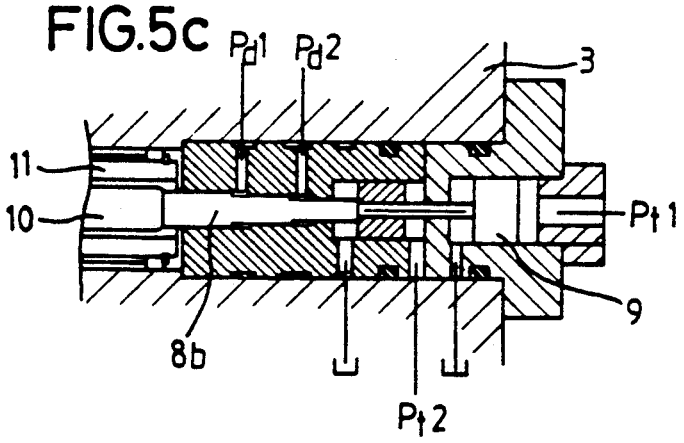

In this case, the servo valve and the servo piston 4 move in the same manner as described in the horsepower control operation even though the pump delivery Q is more reduced as much as the external pilot pressure Pt applied to the pump delivery control biasing piston 9. Here as represented in the diagram of FIG. 8*a*, the higher the pump delivery pressure Pd is, the less the difference of the pump delivery Q with respect to variation of the external pilot pressure Pt under the same pump delivery pressure Pd is. In addition, at any pump delivery pressure Pd, the pump delivery Q is changed in response to the variation of the external pilot pressure Pt at a given ratio. As a result, the control system of the present invention makes it possible to minutely control the pump delivery Q at any pump delivery pressure condition or any pump torque condition. Also, the Pd-Q diagrams of FIGS. 7*a* and 8*a* can be freely changed by addition of the compression coil spring 13*b*, by controlling lever ratio of the angle lever 15, inclination angle Θ of the angle lever 15 and preset neutral positions of the servo spool 10 and the sleeve 11. Furthermore as shown in FIGS. 5*b* and 5*c*, when a stepped piston 8*a* or 8*b*, to which pump delivery pressures Pd1 and Pd2 of at least two pumps are applied at the same time, is substituted for the horsepower control biasing piston 8 of the primary alternate embodiment, it is possible to control, using one control system, at least two hydraulic pumps of the variable displacement type at the same time. FIGS. 5*a* to 5*c* show different embodiments of a horsepower control biasing piston and a pump delivery control biasing piston in accordance with the present invention, respectively. FIG. 5*a* shows the primary embodiment of FIG. 1 wherein the pump delivery pressure Pd of a pump is applied to the horsepower control piston 8 while the external pilot pressure Pt is applied to the pump delivery control piston 9. Meanwhile, the other drawings, FIGS. 5*b* and 5*c*, show that the stepped pistons 8*a* and 8*b* are substituted for the piston 8, respectively, in order to permit the pump delivery pressures Pd1 and Pd2 of two pumps to be applied to the horsepower control piston at the same time. Also, as shown in FIG. 5*c*, a sealed space may be provided between the pistons 8*b* and 9 in order to permit a second external pilot pressure Pt2 together with a first external pilot pressure Pt1 to be applied to the servo spool 10.

As described above, the present invention provides a control system for a hydraulic pump of the variable displacement type which is provided with an incorporated servo mechanism for performing horsepower control as well as pump delivery control, thereby simplifying a construction of the system including conduits and, in this respect, facilitating manufacturing process and reducing manufacturing cost. Also at any pump delivery, the present control system permits the pump delivery to be freely controlled in proportion to the external pilot pressure across the whole range of external pilot pressure, thus improving reliability in controlling the pump delivery. Furthermore, the present invention makes it possible to optimally utilize the engine output power at any pump delivery pressure.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. In a control system for a hydraulic pump of the variable displacement type, comprising a movable servo piston for varying inclination angle of pump swash plate in order to control pump delivery, said servo piston being movably received in a servo cylinder and providing, in cooperation with said servo cylinder, variable smaller and larger cylinder chambers, said smaller cylinder chamber being always applied with pump delivery pressure and said larger cylinder chamber being selectively applied with the pump delivery pressure through a conduit, the improvement comprising;

a servo valve for controlling said conduit in response to the pump delivery pressure and external pilot pressure in order to control movement of said servo piston, said servo valve being movable between three position, a drain position wherein the pump delivery pressure in said larger cylinder chamber is drained to an oil reservoir through said conduit, a neutral position wherein said conduit is blocked, and a feeding position wherein said larger cylinder chamber is applied with the pump delivery pressure through said conduit; further comprising:

a servo spool for controlling said conduit in order to control the pump delivery pressure applied to said larger cylinder chamber, said servo spool being movable in response to said pump delivery pressure and said external pilot pressure in order to be displaced between said three positions;

a servo sleeve for movably receiving said servo spool, said servo sleeve being displaceable in response to the movement of the servo piston in order to control, in cooperation with said servo spool, said conduit;

a pump delivery pressure responding piston for biasing said servo spool in response to the pump delivery pressure applied thereto;

an external pilot pressure responding piston for biasing said servo spool in response to the external pilot pressure applied thereto, said external pilot pressure responding piston being coaxially arranged with said pump delivery pressure responding piston;

a pair of first biasing members for biasing said servo spool against biasing force acting on said servo spool owing to the pump delivery pressure and the external pilot pressure; and, a second biasing member for biasing said servo sleeve; and, a lever assembly for causing said servo sleeve to move in accordance with the movement of said servo piston, said lever assembly comprising:

a hinged lever for causing said servo sleeve to move, said lever being pivoted at one end thereof to said servo spool and being turnable about its hinged point; and a push pin for causing said lever to be turned in accordance with the movement of said servo piston, said pin being connected to said servo piston;

said hinged lever having an inclined surface for movably contacting with said push pin, said inclined surface causing displacement of said servo piston as a function of displacement of said pressure responding pistons to show a characteristic hyperbola.

* * * * *